US012768077B2

(12) United States Patent
Walczyk et al.

(10) Patent No.: US 12,768,077 B2
(45) Date of Patent: Oct. 20, 2026

(54) PEELING DECORTICATOR FOR PRODUCING UNDAMAGED NATURAL FIBER FROM BAST FIBER PLANTS

(71) Applicant: Rensselaer Polytechnic Institute, Troy, NY (US)

(72) Inventors: Daniel F. Walczyk, Troy, NY (US); Timothy G. Schwed, Nashua, NH (US); Jacqueline Anne Richard, Hooksett, NH (US)

(73) Assignee: Rensselaer Polytechnic Institute, Troy, NY (US)

( * ) Notice: Subject to any disclaimer, the term of this patent is extended or adjusted under 35 U.S.C. 154(b) by 0 days.

(21) Appl. No.: 19/102,583

(22) PCT Filed: Aug. 10, 2023

(86) PCT No.: PCT/US2023/029955

§ 371 (c)(1),
(2) Date: Feb. 10, 2025

(87) PCT Pub. No.: WO2024/035856

PCT Pub. Date: Feb. 15, 2024

(65) Prior Publication Data

US 2026/0055535 A1 Feb. 26, 2026

Related U.S. Application Data

(60) Provisional application No. 63/396,701, filed on Aug. 10, 2022.

(51) Int. Cl.
*D01B 1/22* (2006.01)
*D01B 1/14* (2006.01)
(Continued)

(52) U.S. Cl.
CPC ..... *D01B 1/22* (2013.01); *D01B 1/14* (2013.01); *D01B 1/24* (2013.01); *D01B 1/32* (2013.01);
(Continued)

(58) Field of Classification Search
CPC ..... D01B 1/22; D01B 1/14; D01B 1/24; D01B 1/32; D01B 1/34; D01B 1/36; D01B 1/44; D01B 1/46
(Continued)

(56) References Cited

U.S. PATENT DOCUMENTS 388,664 A * 8/1888 Green ..... D01B 1/14 19/30
4,312,677 A * 1/1982 Tilby ..... C13B 5/00 127/2
(Continued)

FOREIGN PATENT DOCUMENTS

CA 2386405 A1 4/2000
CA 2919565 A1 * 8/2017 ..... D01B 1/20
(Continued)

OTHER PUBLICATIONS

International Search Report and Written Opinion in corresponding PCT Application No. PCT/US2023/029955 mailed Oct. 31, 2023, 8 pages.

*Primary Examiner* — Aiying Zhao
(74) *Attorney, Agent, or Firm* — Barclay Damon LLP; Anthony P. Gangemi

(57) ABSTRACT

A plant stalk decorticator includes a pair of feed rollers arranged abutting one another along a substantially horizontal axis with a line of contact therebetween. A splitting wedge is positioned at least partially below the pair of feed rollers and aligned along a substantially vertical axis that is substantially centrally located in the line of contact between
(Continued)

the pair of feed rollers, the splitting wedge is configured to split a plant stalk fed from the pair of feed rollers into two plant fiber bark sections. Symmetrical pairs of vertically stacked peeling rollers are positioned below the pair of feed rollers and laterally from either side of the substantially vertical axis. Each of the pairs of peeling rollers are configured to receive a respective one of the plant fiber bark sections from the splitting wedge and separate the plant fiber bark section from the respective other one of the plant fiber bark sections.

26 Claims, 11 Drawing Sheets

(51) Int. Cl.

| | |
|---|---|
| ***D01B 1/24*** | (2006.01) |
| ***D01B 1/32*** | (2006.01) |
| ***D01B 1/34*** | (2006.01) |
| ***D01B 1/36*** | (2006.01) |
| ***D01B 1/44*** | (2006.01) |
| ***D01B 1/46*** | (2006.01) |

(52) U.S. Cl.
CPC ..... *D01B 1/34* (2013.01); *D01B 1/36* (2013.01); *D01B 1/44* (2013.01); *D01B 1/46* (2013.01); *D10B 2201/01* (2013.01)

(58) Field of Classification Search
USPC ..... 19/5 R, 10
See application file for complete search history.

(56) References Cited

U.S. PATENT DOCUMENTS

| | | | | |
|---|---|---|---|---|
| 5,447,276 | A * | 9/1995 | Aldridge | D01B 1/22 241/222 |
| 9,957,642 | B2 | 5/2018 | Dyas | |
| 10,745,859 | B2 | 8/2020 | Ramaratnam et al. | |
| 2022/0056618 | A1* | 2/2022 | Beaven | D01B 1/16 |
| 2023/0128312 | A1* | 4/2023 | Harrap | D01B 1/24 19/5 R |

FOREIGN PATENT DOCUMENTS

| | | | | |
|---|---|---|---|---|
| CN | 105780130 | A | 7/2016 | |
| CN | 111534860 | A | 8/2020 | |
| WO | 1997045573 | A1 | 12/1997 | |
| WO | WO-9745573 | A1 * | 12/1997 | D01B 1/22 |
| WO | WO-0020667 | A1 * | 4/2000 | D01B 1/22 |
| WO | 2019210221 | A1 | 10/2019 | |
| WO | WO-2022118265 | A1 * | 6/2022 | D01B 1/22 |
| WO | 2022140857 | A1 | 7/2022 | |

* cited by examiner

PEELING DECORTICATOR FOR PRODUCING UNDAMAGED NATURAL FIBER FROM BAST FIBER PLANTS

CROSS REFERENCE TO RELATED APPLICATIONS

This application claims the priority benefit of U.S. Provisional Patent Application No. 63/396,701, filed Aug. 10, 2022, which is incorporated by reference as if disclosed herein in its entirety.

FIELD

The present technology relates generally to the field of plant decortication, and more particularly, to a decorticator for producing undamaged natural fiber from bast fiber plants.

BACKGROUND

Around the world there has been an increased focus on finding more sustainable and environmentally friendly options for a variety of manufacturing industries and practices. The composites industry, for example, is one with significant waste, a large carbon footprint, and poor end-of-life options. There has been a recent trend to reduce this impact by replacing synthetic fibers (e.g., E-glass, Aramid) with natural fibers. Hemp fiber has come forward as a competitive alternative to synthetics due to its high strength-to-weight and modulus-to-weight ratios, carbon-negative footprint, and economic competitiveness when compared to other common natural fibers like cotton. Although hemp fiber has been used for centuries, there are still improvements to be made to the processing of the fiber. The current automated decortication processes—the automated process to separate the hemp fiber from its inner woody core called "hurd or shive"—is typically an aggressive process that can damage fibers and results in a tangled mess. The resulting fiber quality, while efficiently produced, is not of high enough quality to be used for advanced composite applications.

What is needed, therefore, is an improved apparatus, system, and method of plant stalk decortication that addresses at least the problems described above.

SUMMARY

According to an embodiment of the present technology, a plant stalk decorticator is provided. The plant stalk decorticator includes a frame; a pair of feed rollers attached to the frame, the pair of feed rollers are arranged abutting one another along a substantially horizontal axis with a line of contact therebetween, the pair of feed rollers are configured to receive a plant stalk in the line of contact and at least partially flatten and feed the plant stalk below the pair of feed rollers in a substantially vertical orientation; a splitting wedge attached to the frame and positioned at least partially below the pair of feed rollers and aligned along a substantially vertical axis that is substantially centrally located in the line of contact between the pair of feed rollers, the splitting wedge is configured to split the plant stalk fed from the pair of feed rollers into two halves including separate plant fiber bark sections; a first pair of peeling rollers attached to the frame, the first pair of peeling rollers are arranged adjacent one another substantially parallel to the substantially vertical axis and are positioned below the pair of feed rollers and laterally from a first side of the substantially vertical axis; and a second pair of peeling rollers attached to the frame, the second pair of peeling rollers are arranged adjacent one another substantially parallel to the substantially vertical axis and are positioned below the pair of feed rollers and laterally from a second side of the substantially vertical axis such that the first pair of peeling rollers and the second pair of peeling rollers are substantially symmetrical about the substantially vertical axis. Each of the first and second pairs of peeling rollers are configured to receive a respective one of the plant fiber stalk halves from the splitting wedge and separate the plant fiber stalk half from the respective other one of the plant fiber stalk halves thereby forming the separate plant fiber bark sections.

In some embodiments, the splitting wedge includes a bottom portion having a rectangular cross section, and a top portion having opposing tapered sides that form a triangular cross section. The top portion is configured to split the plant stalk into the two plant fiber bark sections.

In some embodiments, the splitting wedge is moveable between a top splitting position and a bottom passive position. When the splitting wedge is in the bottom passive position, it does not interfere the downward movement of an intact hurd resulting from the splitting of the plant stalk into the plant fiber bark sections.

In some embodiments, the splitting wedge is manually or automatically moved from the top splitting position to the bottom passive position after the splitting wedge has split the plant stalk and directed the plant fiber bark sections to the first and second pair of peeling rollers.

In some embodiments, when the splitting wedge is in the top splitting position, a top point of the splitting wedge is within the range of about 3.2 mm below a substantially horizontal plane defined by a bottom of the pair of feed rollers to about 3.2 mm above the substantially horizontal plane defined by the bottom of the pair of feed rollers.

In some embodiments, when the splitting wedge is in the top splitting position, the top point of the splitting wedge is substantially aligned with the substantially horizontal plane defined by the bottom of the pair of feed rollers.

In some embodiments, when the splitting wedge is in the top splitting position, the top point of the splitting wedge is about 3.2 mm above the substantially horizontal plane defined by the bottom of the pair of feed rollers.

In some embodiments, each of the first and second pairs of peeling rollers include a top drive peeling roller and a bottom driven peeling roller. The top drive peeling roller has a diameter that is smaller than a diameter of the bottom driven peeling roller.

In some embodiments, the first and second pairs of peeling rollers are positioned such that the downward-moving plant fiber bark sections impinge the bottom driven peeling rollers.

In some embodiments, a plant stalk loader is attached to a top of the frame. The plant stalk loader is configured to load at least one plant stalk into the line of contact between the pair of feed rollers.

In some embodiments, the plant stalk loader includes a plurality of compartments formed into a matrix having a plurality of rows and a plurality of columns, and a support shelf positioned below the plurality of compartments.

In some embodiments, the plant stalk loader is positioned on a track attached to the top of the frame. The plant stalk loader is configured to slide along the track to load plant stalks from each of the plurality of rows of compartments sequentially into the line of contact between the pair of feed rollers via a slot in the support shelf.

In some embodiments, a cutting mechanism is positioned adjacent an exit side of each of the first and second pairs of peeling rollers. The cutting mechanism is configured to cut the plant fiber bark sections that exit the pairs of peeling rollers into a plurality of fiber bark strips having a predetermined uniform length.

In some embodiments, the cutting mechanism includes a guillotine cutter that is configured to move substantially vertically up and down at predetermined intervals to shear and cut the plant fiber sections. In some embodiments, the motion of the guillotine cutter is coordinated with the rotation of the top drive peeling roller.

In some embodiments, the cutting mechanism includes a cutting wheel having a plurality of protrusions and is configured to rotate such the protrusions cut the plant fiber sections. In some embodiments, the rotation of the cutting wheel is coordinated with the rotation of the top drive peeling roller.

In some embodiments, the rotational speed of the first and second top drive peeling rollers are coordinated mechanically or electromechanically.

In some embodiments, the rotational speed of the pair of feed rollers is coordinated mechanically or electromechanically with the rotational speed of the first and second top drive peeling rollers such that a velocity of the plant stalk fed through the pair of feed roller is equal to a velocity of the plant fiber bark sections pulled through the first and second pairs of peeling rollers.

In some embodiments, the plant stalk is from a bast fiber plant. In some embodiments, the bast fiber plant is hemp and/or flax.

In some embodiments, each of the pair of feed rollers and the first and second pairs of peeling rollers includes a metal roller coated with a layer of rubber.

In some embodiments, each of the pair of feed rollers and the first and second pairs of peeling rollers includes a solid metal roller.

Further objects, aspects, features, and embodiments of the present technology will be apparent from the drawing Figures and below description.

BRIEF DESCRIPTION OF DRAWINGS

Some embodiments of the present technology are illustrated as an example and are not limited by the figures of the accompanying drawings, in which like references may indicate similar elements.

DETAILED DESCRIPTION

Figure 1:
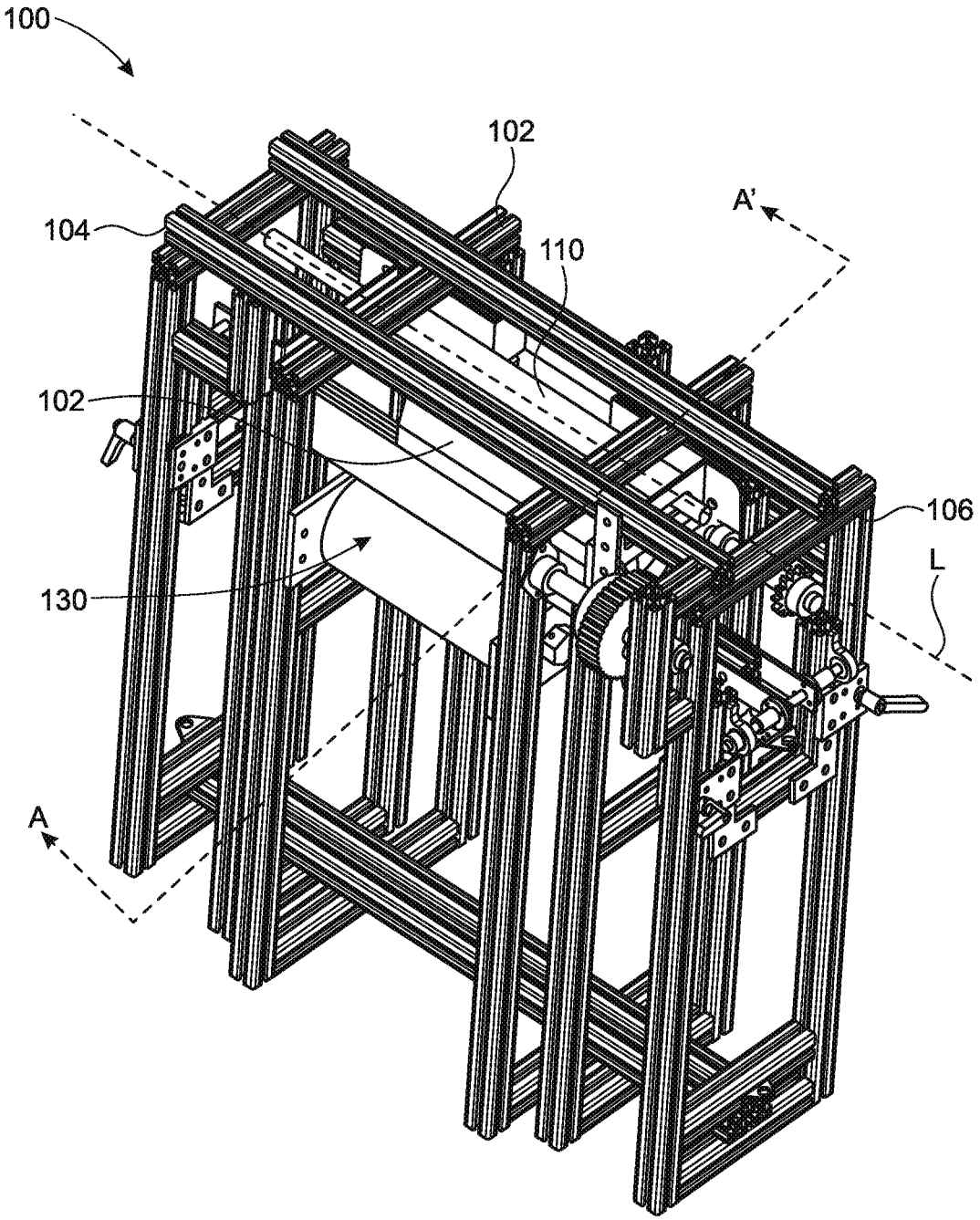
FIG. 1 is an isometric view of a plant stalk decorticator according to some embodiments of the present technology.
Figure 2:
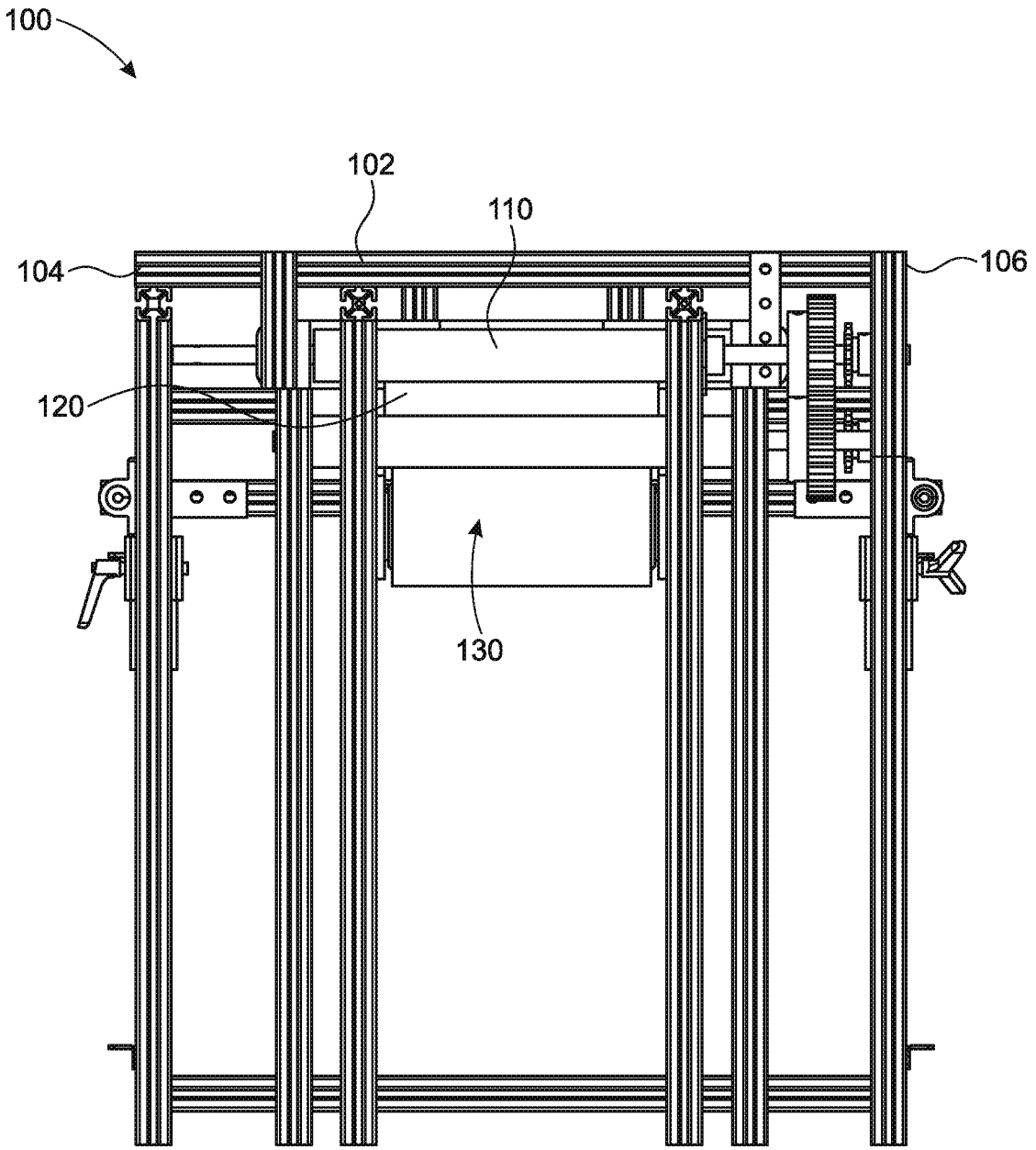
FIG. 2 is a front elevational view of the plant stalk decorticator of FIG. 1.

As shown in FIGS. 1-2, a plant stalk decorticator is generally designated by the numeral 100. The decorticator 100 includes a frame 102 having a first end 104 and a second end 106 defining a longitudinal axis L of the decorticator 100. A pair of feed rollers 110 are attached to the frame 102 and aligned substantially parallel to the longitudinal axis L. A vertically sliding splitting wedge 120 is attached to the frame 102 and aligned substantially parallel to the longitudinal axis L. A first pair of peeling rollers 130 are attached to the frame 102 and aligned substantially parallel to the longitudinal axis L. A second pair of peeling rollers 140 are attached to the frame 102 and aligned substantially parallel to the longitudinal axis L, as shown in FIG. 3.

Figure 3:
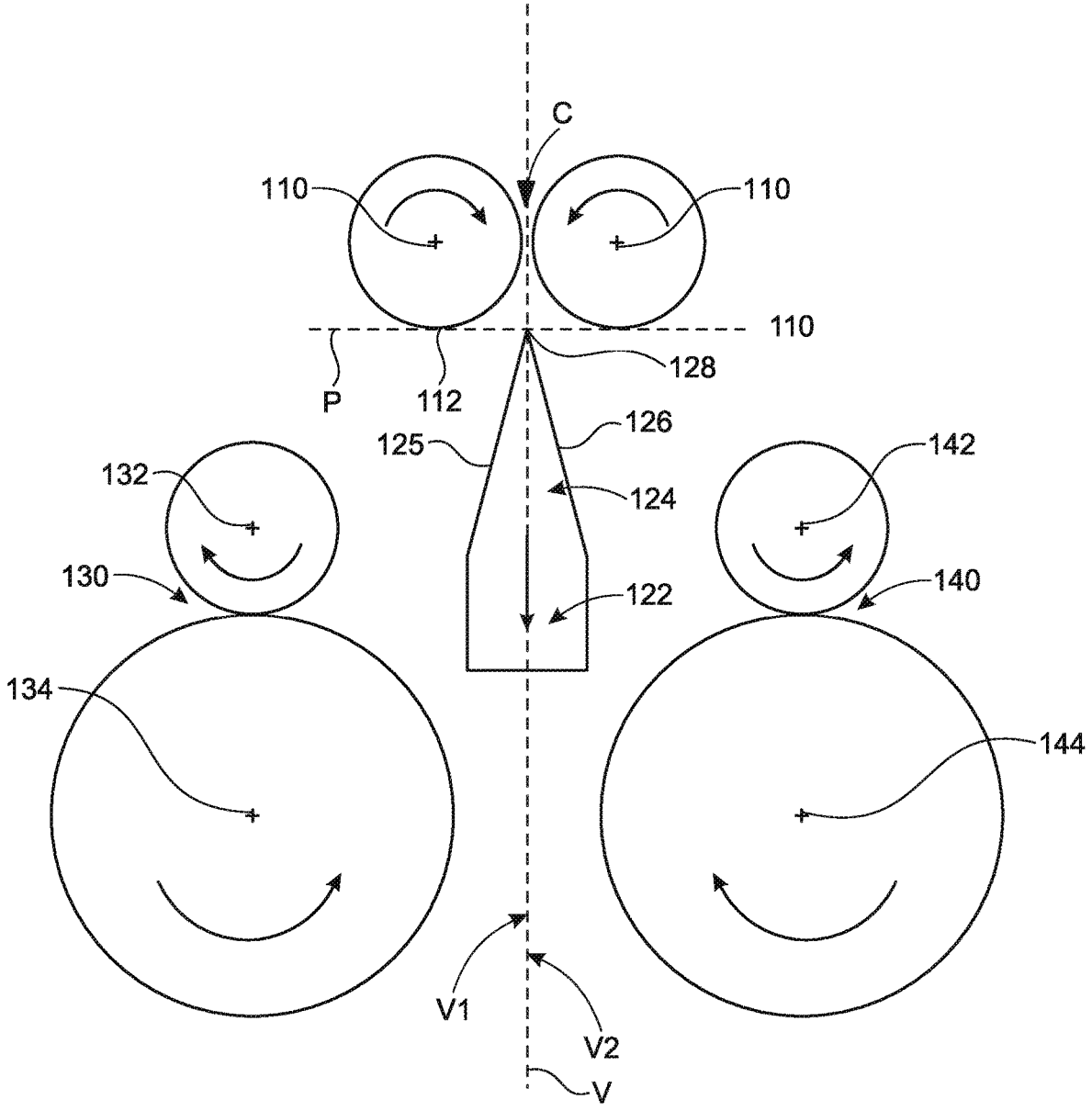
FIG. 3 is a partial cross-sectional view of the plant stalk decorticator taken along section line A-A' of FIG. 1.
Figure 4A:
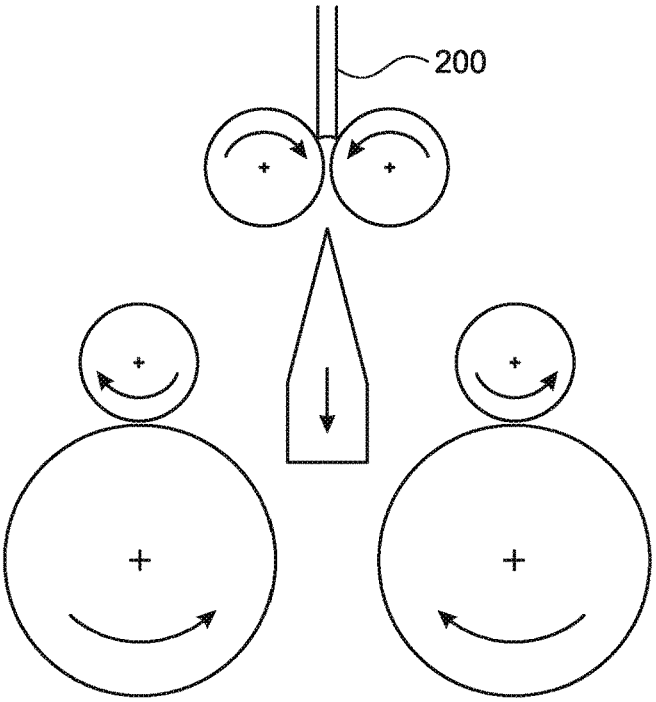
FIGS. 4A-4G are partial cross-sectional views of the plant stalk decorticator showing a method for plant stalk decortication according to some embodiments of the present technology.
Figure 4B:
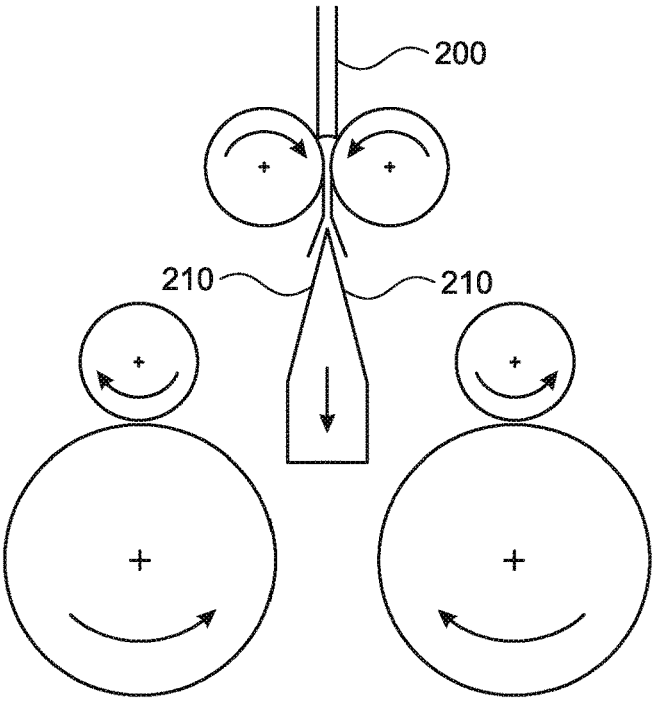

As shown in FIG. 3, the pair of feed rollers 110 are arranged adjacent to one another along a substantially horizontal axis H. The pair of feed rollers 110 are positioned abutting each out such that a line of contact C exists therebetween. In some embodiments, one feed roller 100 is forced into the other feed roller 100 using compressed springs. The pair of feed rollers 110 are configured to receive a plant stalk 200 in the line of contact C and compress and feed the plant stalk 200 below the pair of feed rollers 110 in a substantially vertical orientation, as shown in FIGS. 4A-4B. In some embodiments, the plant stalk 200 is from a bast fiber plant. In some embodiments, the bast fiber plant is hemp. In some embodiments, the bast fiber plant is flax, jute, kenaf, ramie, roselle, sunn, urena, etc., or combinations thereof.

Figure 4C:
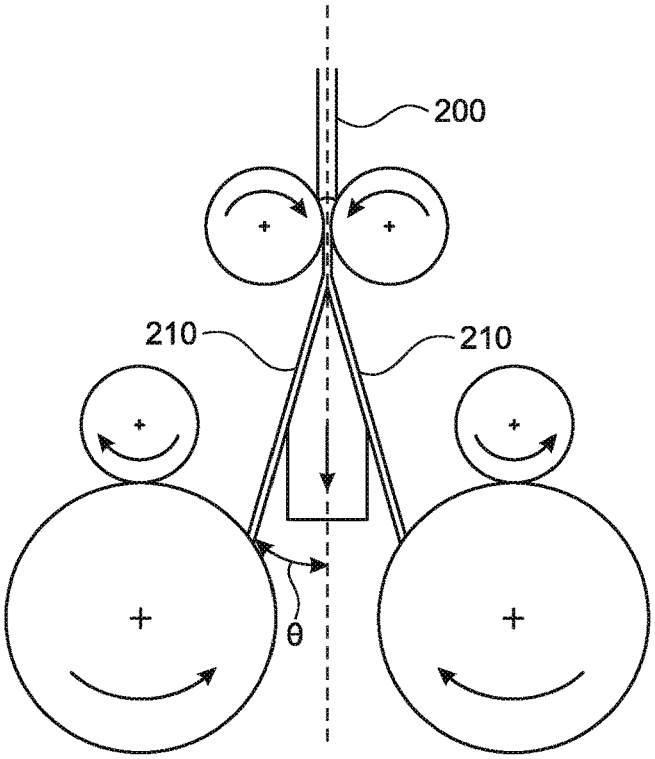

As shown in FIG. 3, the splitting wedge 120 is positioned at least partially below the pair of feed rollers 110 and aligned along a substantially vertical axis V that is substantially centrally located in the line of contact C between the pair of feed rollers 110. The splitting wedge 120 includes a bottom portion 122 that has a rectangular cross section, and a top portion 124 that has opposing tapered sides 125, 126 such that the top portion 124 has a triangular cross section. A top point 128 of the top portion 124 is sharp and configured to split the plant stalk 200 fed from the pair of feed rollers 110 into two plant stalk halves 210. The tapered sides 125, 126 of the top portion 124 are configured to direct the two plant stalk halves 210 to the first pair of peeling rollers 130 and the second pair of peeling rollers 140, as shown in FIGS. 4B-4C.

Figure 4D:
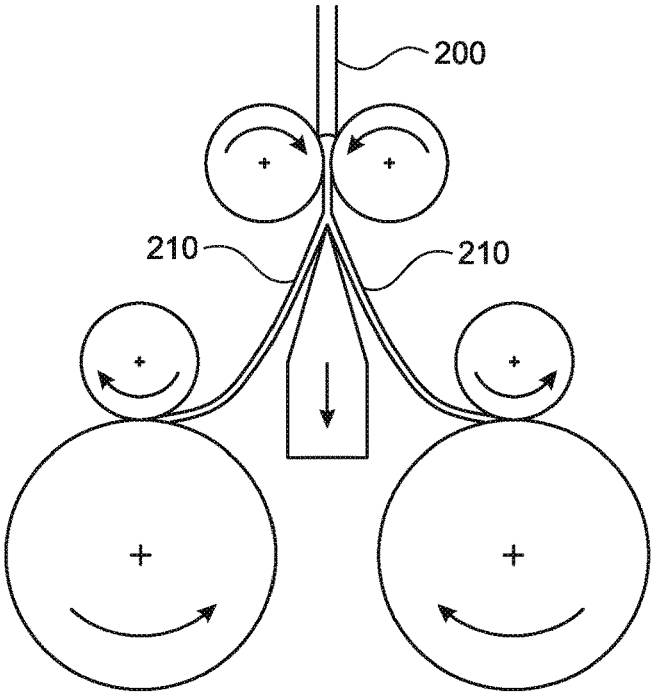
Figure 4E:
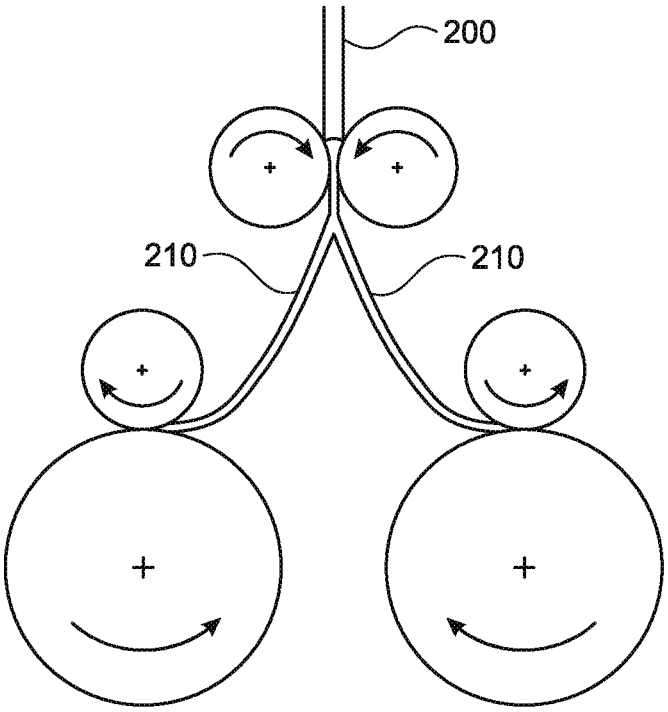
Figure 4F:
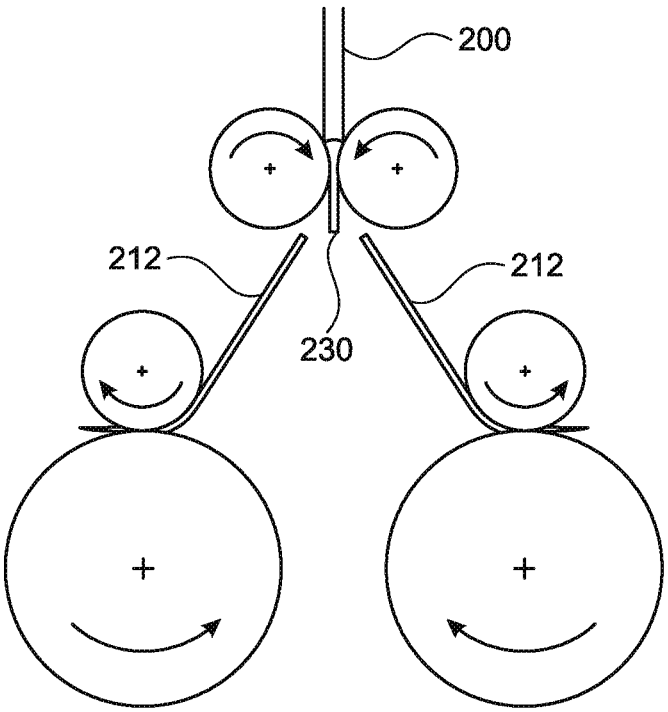
Figure 4G:
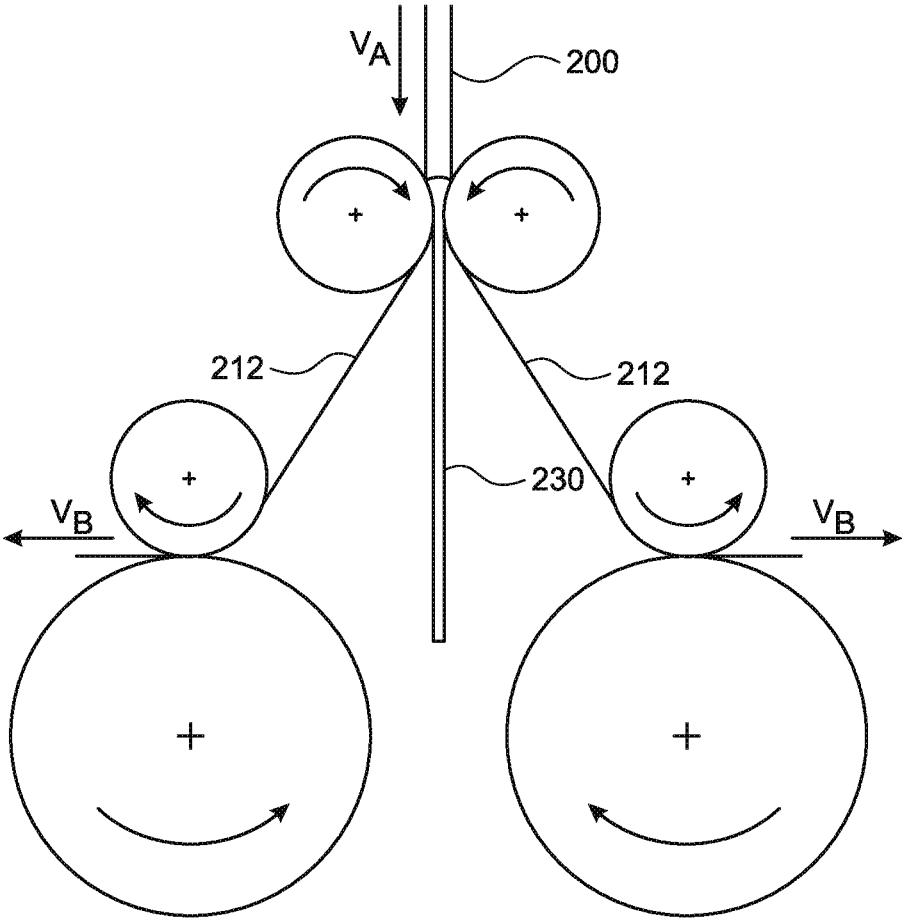

In some embodiments, the splitting wedge 120 is moveable along the substantially vertical axis V between a top splitting position and a bottom passive position. As shown in FIGS. 4A-4G, the splitting wedge 120 descends from the top splitting position to the bottom passive position after the splitting wedge 120 has split the plant stalk 200 and directed the plant stalk halves 210 to the first pair of peeling rollers 130 and the second pair of peeling rollers 140. In some embodiments, the splitting wedge 120 is manually movable between the top splitting position and the bottom passive position via, for example, linkage, cams, a gear train, or any other manual height adjustable means known in the art. In some embodiments, the splitting wedge 120 is automatically movable between the top splitting position and the bottom passive position via, for example, a controlled pneumatic or hydraulic piston, or any other automatic height adjustable means known in the art. In some embodiments, when the splitting wedge 120 is in the top splitting position, the top point 128 of the splitting wedge 120 is located within the range of about 3.2 mm (⅛") below a plane P defined by a bottom 112 of the pair of feed rollers 110 to about 3.2 mm (⅛") above the plane P, as shown in FIG. 3. In some embodiments, when the splitting wedge 120 is in the top splitting position, the top point 128 of the splitting wedge 120 is located about 3.2 mm (⅛") above the plane P. In some embodiments, when the splitting wedge 120 is in the top splitting position, the top point 128 of the splitting wedge 120 is located substantially level (i.e., aligned or flush) with the plane P. In some embodiments, when the splitting wedge 120 is in the top splitting position, the top point 128 of the splitting wedge 120 is located about 3.2 mm (⅛") below the plane P. In some embodiments, the splitting wedge 120 is rapidly moved to the bottom passive position after splitting the plant stalk 200 such that the resulting plant hurd 230 can freely descend between the first and second pairs of peeling rollers 130, 140, as shown in FIGS. 4F-4G, to be collected in, for example, a container as is or ground up into small particles.

As shown in FIG. 3, the first pair of peeling rollers 130 are arranged adjacent to one another in a substantially vertical orientation that is substantially parallel to the substantially vertical axis V. The first pair of peeling rollers 130 are positioned below the pair of feed rollers 110 and laterally from a first side V1 of the substantially vertical axis V. In some embodiments, the first pair of peeling rollers 130 includes a first top drive peeling roller 132 and a first bottom driven peeling roller 134. In some embodiments, the first top drive peeling roller 132 has a diameter that is smaller than a diameter of the first bottom driven peeling roller 134.

As shown in FIG. 3, the second pair of peeling rollers 140 are arranged adjacent to one another in a substantially vertical orientation that is substantially parallel to the substantially vertical axis V. The second pair of peeling rollers 140 are positioned below the pair of feed rollers 110 and laterally from a second side V2 of the substantially vertical axis V. In some embodiments, the second pair of peeling rollers 140 includes a second top drive peeling roller 142 and a second bottom driven peeling roller 144. In some embodiments, the second top drive peeling roller 142 has a diameter that is smaller than a diameter of the second bottom driven peeling roller 144.

In some embodiments, the first pair of peeling rollers 130 and the second pair of peeling rollers 140 are positioned substantially equidistant below the pair of feed rollers 110 and substantially equidistant laterally from the substantially vertical axis V such that the first and second pairs of peeling rollers 130, 140 are substantially symmetrical about the substantially vertical axis V. In some embodiments, the first and second top drive peeling rollers 132, 142 have substantially equal diameters, and the first and second bottom driven peeling rollers 134, 144 have substantially equal diameters. The first and second pairs of peeling rollers 130, 140 are each configured to receive a respective one of the plant stalk halves 210, bend the stalk halves away from vertical axis V by virtue of the rotation of the first and second bottom driven peeling rollers 134, 144, thereby breaking the hurd tips with fiber bark still attached 212, as shown in FIGS. 4C-4E, peeling the fiber bark 212 away from the intact hurd 230 and exiting horizontally between the first and second pairs of peeling rollers 130, 140, as shown in FIGS. 4F-4G. As shown, the plant fiber bark sections 212 are received on the bottom driven peeling rollers 134, 144, which then pull the plant fiber bark sections 212 to the top drive peeling rollers 132, 142 to compress the plant fiber bark sections 212 between the top and bottom rollers and peel the plant fiber bark sections 212 from the plant stalk 200. In some embodiments, the first and second pairs of peeling rollers 130, 140 are positioned such that the plant fiber bark sections 212 contact the bottom driven peeling rollers 134, 144 at an angle θ from the substantially vertical axis V, as shown in FIG. 4C. In some embodiments, the angle θ is between about 10° to about 20°. In some embodiments, the angle θ is between about 13° to about 17°. In some embodiments, the angle θ is between about 15° to about 16°. In some embodiments, the angle θ is about 15.65°.

In some embodiments, the rotational speed of the pair of feed rollers 110 is coordinated with the rotational speed of the first and second top drive peeling rollers 132, 142 such that a velocity $V_A$ of the plant stalk 200 fed through the pair of feed rollers 110 is equal to a velocity $V_B$ of the plant fiber bark sections 212 pulled through the first and second pairs of peeling rollers 130, 140, as shown in FIG. 4G. In some embodiments, the rotational speeds of the pair of feed rollers 110 and the first and second top drive peeling rollers 132, 142 are coordinated mechanically via, for example, chain drives. In some embodiments, the rotational speeds of the pair of feed rollers 110 and the first and second top drive peeling rollers 132, 142 are coordinated electromechanically via, for example, servo drive control. The rotational speeds of each of the pair of feed rollers 110 are equal, but in opposite directions, as shown in FIGS. 3-4G. In some embodiments, rotation of the pair of feed rollers 110 is coordinated by a high compression load from, for example, a compressed spring or a pneumatic or hydraulic piston to maintain high friction between the feed rollers 110. In some embodiments, rotation of the pair of feed rollers 110 is coordinated by a set of meshing spur gears connected to each feed roller 110. In some embodiments, the first and second top drive peeling rollers 132, 142 have high compression forced applied thereto via, for example, compressed springs or pneumatic or hydraulic pistons. In some embodiments, rotation of the first and second top drive peeling rollers 132, 142 are coordinated mechanically via, for example, chain drives. In some embodiments, rotation of the first and second top drive peeling rollers 132, 142 are coordinated electromechanically via, for example, servo drive control. In some embodiments, the pair of feed rollers 110 are manually rotated via a hand crank 150, as shown in FIG. 6.

Figure 5:
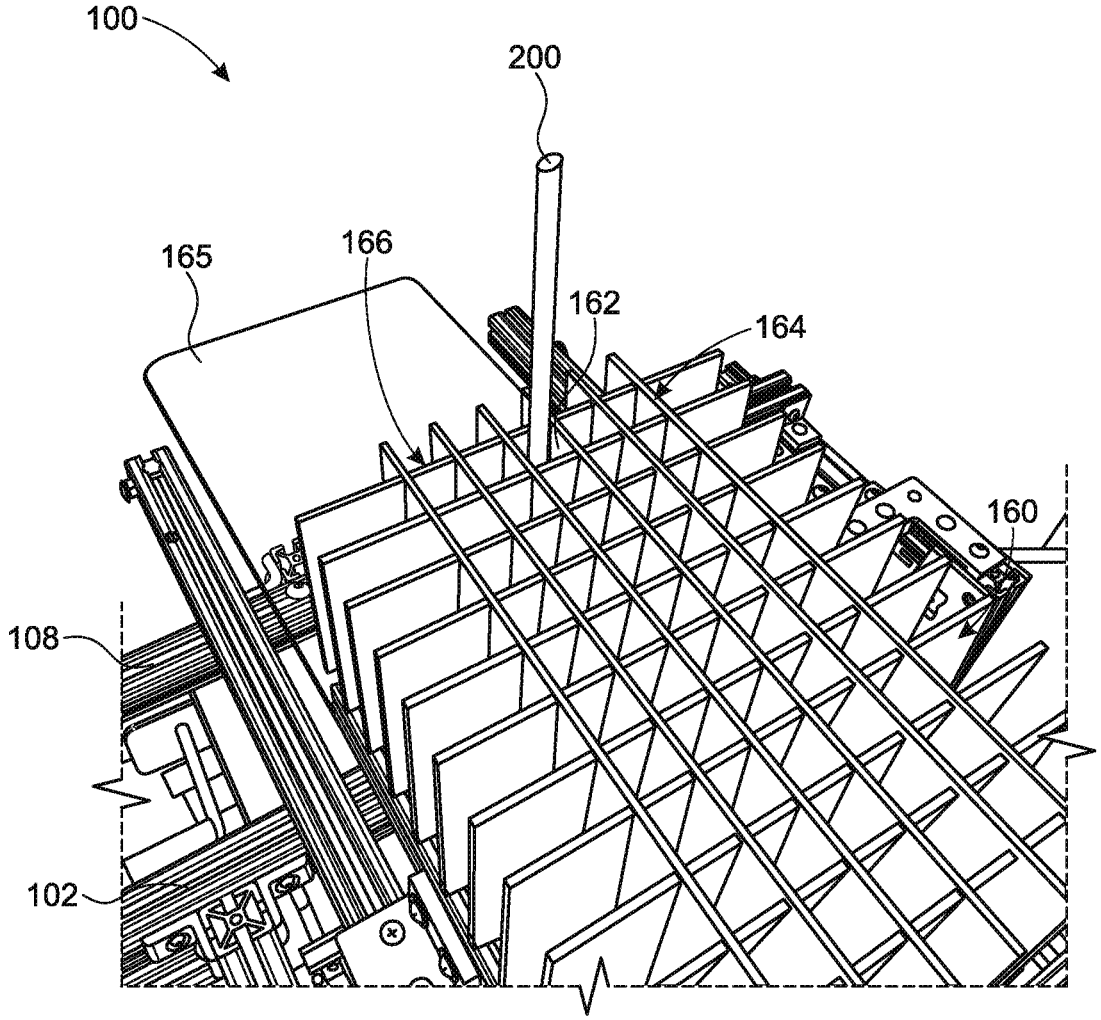
FIG. 5 is a top isometric view of a plant stalk loader attached to the top of a plant stalk decorticator according to some embodiments of the present technology.
Figure 6:
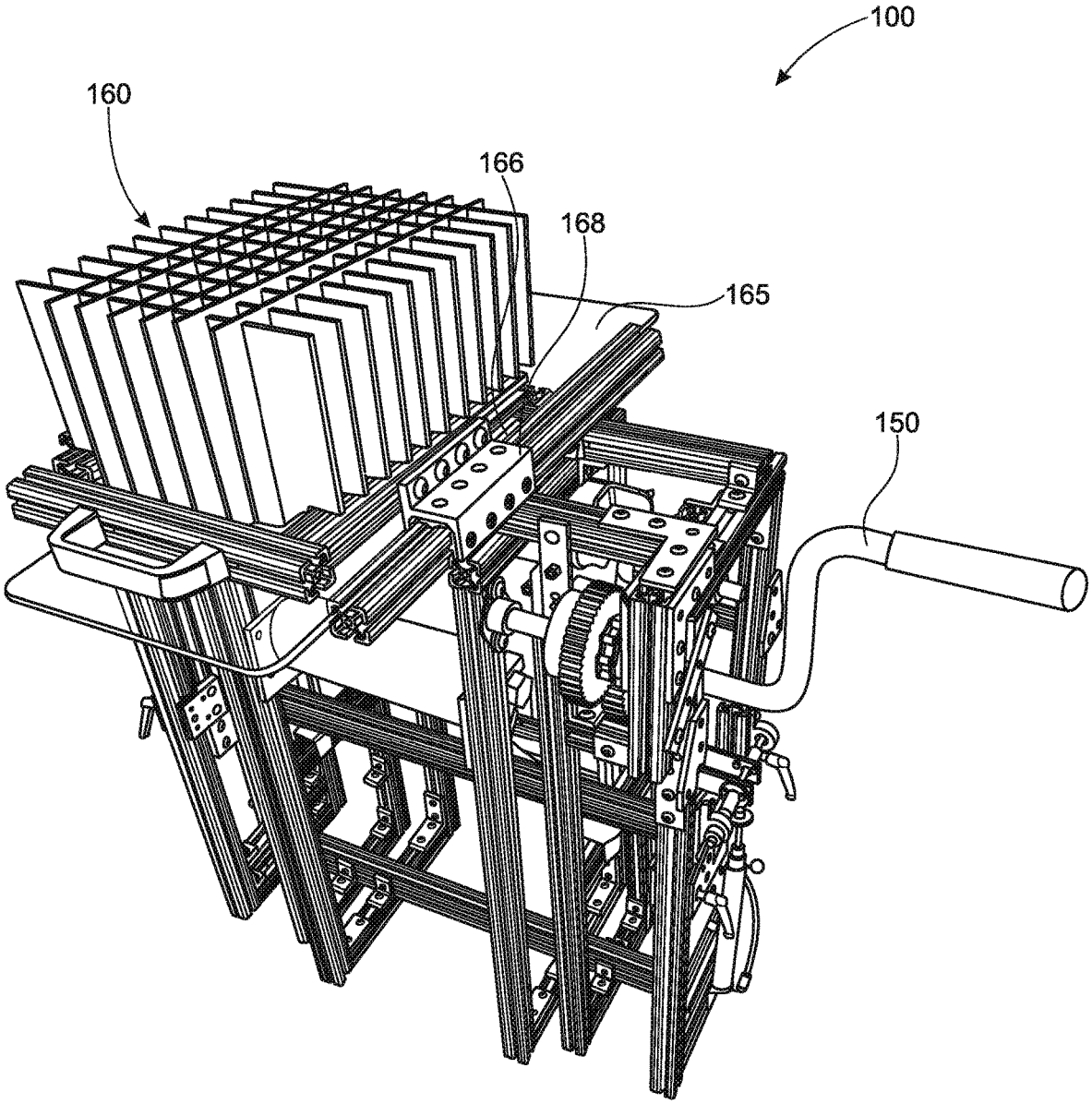
FIG. 6 is an isometric view of the plant stalk decorticator of FIG. 5.

In some embodiments, the decorticator 100 includes a plant stalk loader 160 that is attached to a top 108 of the frame 102, as shown in FIGS. 5-6. The plant stalk loader 160 is configured to load a plurality of plant stalks 200 into the line of contact C between the pair of feed rollers 110. In some embodiments, the plant stalk loader 160 includes a plurality of compartments 162 formed as a matrix having a plurality of rows 164 and a plurality of columns 166, as shown in FIG. 5. In some embodiments, the plant stalks contained in the plant stalk loader are supported vertically by a horizontal shelf 165 affixed to the top 108 of the frame 102. In some embodiments, the plant stalk loader 160 is positioned on a track 168 that is oriented transverse to the longitudinal axis L of the decorticator 100, as shown in FIG. 6. The plant stalk loader 160 is configured to slide along the track 168 and load a plurality of plant stalks 200 from each of the plurality of rows 164 sequentially (i.e., row-by-row), where each row of stalks drops down through a slot 166, such as an oval cutout, in the horizontal shelf 165 into the line of contact C between the pair of feed rollers 110.

Figure 7:
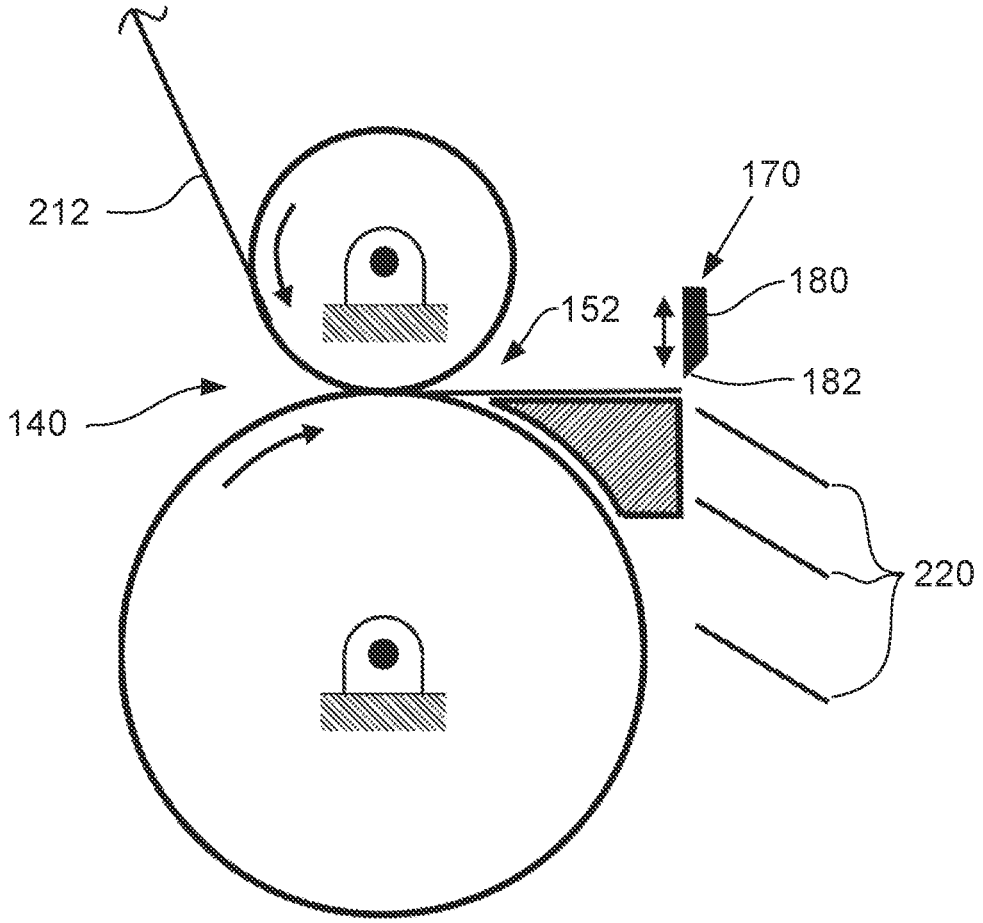
FIG. 7 is a partial cross-sectional view of a cutting mechanism used with the plant stalk decorticator according to some embodiments of the present technology.
Figure 8:
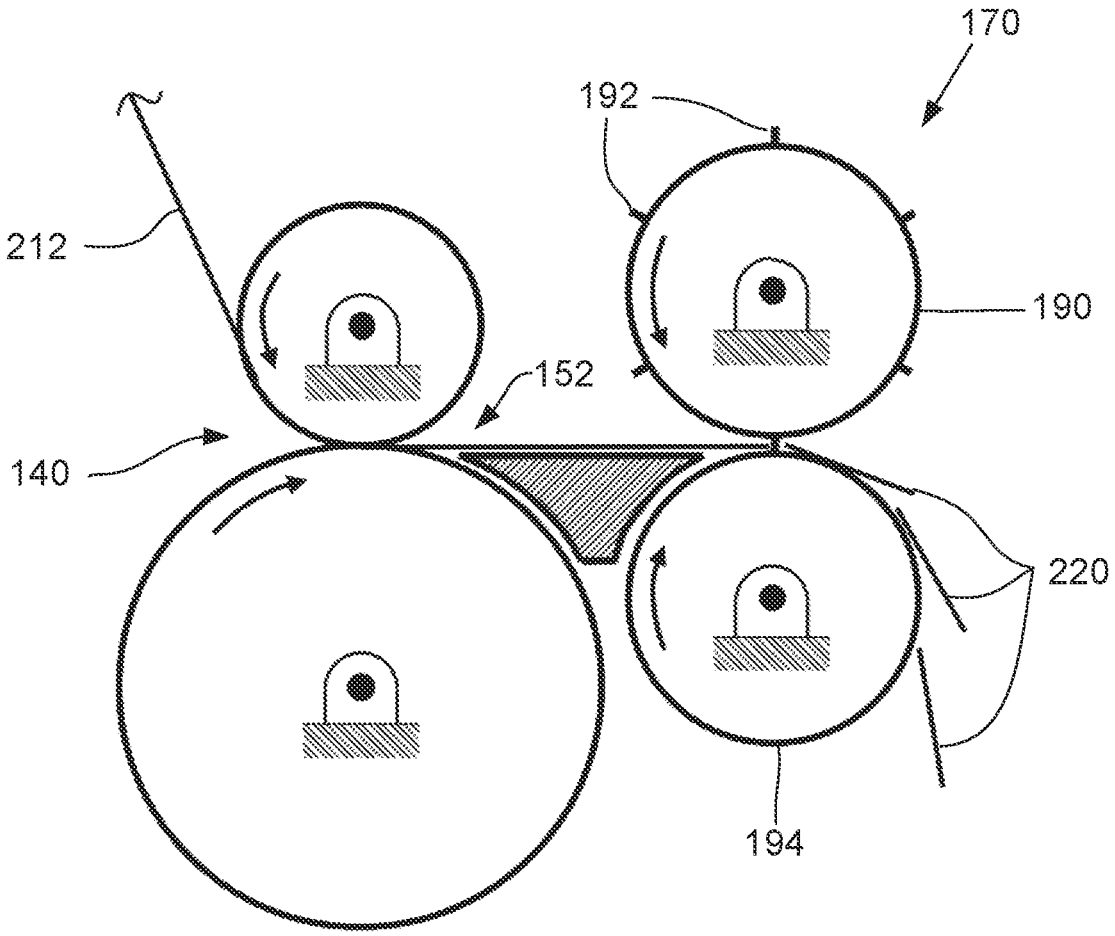
FIG. 8 is a partial cross-sectional view of another cutting mechanism used with the plant stalk decorticator according to some embodiments of the present technology.

As shown in FIGS. 7-8, in some embodiments the decorticator 100 includes a cutting mechanism 170 that is positioned a distance adjacent to an exit side 152 of each of the first and second pairs of peeling rollers 130, 140. The cutting mechanism 170 is configured to cut the plant fiber bark sections 210 that exit the first and second pairs of peeling rollers 130, 140 into a plurality of fiber bark strips 220 having a predetermined uniform length. In some embodiments, the cutting mechanism 170 is a guillotine cutter 180 that has an angled straight blade 182 or serrated blade and is configured to drop down substantially vertically from a starting position to cut the plant fiber sections 210 and then lift back up to the starting position at predetermined intervals, as shown in FIG. 7. In some embodiments, the guillotine cutter 180 is moveable between positions mechanically or electromechanically, as discussed herein. In some embodiments, the motion of the guillotine cutter 180 is coordinated with the rotation of the top drive peeling roller 132, 142.

In some embodiments, the cutting mechanism 170 includes a drive cutting wheel 190 that has a plurality of bladed protrusions 192 extending radially outward from and uniformly spaced along the circumference thereof and a driven polymeric-coated backing wheel 194, as shown in FIG. 8. The polymeric layer on the backing wheel 194 engages the lower side of the fiber bark section 212 and forces the fiber bark section 212 into the bladed protrusion 192 of the cutting wheel 190 to create a clean cut and form a fiber bark strip 220. The spacing of the bladed protrusions 192 and the rotational speed of the cutting wheel 190 determines the length of the cut fiber bark strips 220. In some embodiments, the rotation of the cutting wheel 190 is coordinated with the rotation of the first and second top drive peeling rollers 132, 142 mechanically or electromechanically, as discussed herein.

Preferably, the pair of feed rollers 110 and the first and second pairs of peeling rollers 130, 140 are rubber coated to provide sufficiently high friction while remaining sufficiently deformable to allow plant stalks 200 of varying thickness to be fed through the pinch roller arrangements. In some embodiments, the pair of feed rollers 110 and the first and second pairs of peeling rollers 130, 140 are metal rollers coated with a thin layer of rubber. In some embodiments, pair of feed rollers 110 and the first and second pairs of peeling rollers 130, 140 are metal core rollers with thick layers of rubber. In some embodiments, pair of feed rollers 110 and the first and second pairs of peeling rollers 130, 140 are solid metal rollers.

Accordingly, embodiments of the present technology are directed to an apparatus, system, and method for plant peeling decortication for producing undamaged natural fiber from bast fiber plant stalks, such as hemp and flax. In some embodiments, the system feeds rows of cut, unretted, and dried stalks downward through a set of rollers (e.g., rubber-coated pinch rollers) to crush and flatten the stalk, and then into a wedge (e.g., a stationary knife wedge) to split the crushed stalk (preferably in half). Symmetrical sets of pinch rollers (preferably larger diameter bottom roller) diverts the split stalk halves laterally (sideways) thereby breaking the tip of the hurd/shive stem and starting the bark peeling process. In some embodiments, the wedge moves out of the way (e.g., by rapidly descending) so that the peeled hurd/shive stem moves downward unhindered to be ground up below (e.g., for animal bedding, hempcrete, etc.). In some embodiments, the ribbon of bark with undamaged fiber exits on both sides of the apparatus, where it is left as a continuous ribbon or cut to predetermined lengths (e.g., via an oscillating serrated blade) before degumming.

As will be apparent to those skilled in the art, various modifications, adaptations, and variations of the foregoing specific disclosure can be made without departing from the scope of the technology claimed herein. The various features and elements of the technology described herein may be combined in a manner different than the specific examples described or claimed herein without departing from the scope of the technology. In other words, any element or feature may be combined with any other element or feature in different embodiments, unless there is an obvious or inherent incompatibility between the two, or it is specifically excluded.

References in the specification to "one embodiment," "an embodiment," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described.

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition, or step being referred to is an optional (not required) feature of the technology.

The term "and/or" means any one of the items, any combination of the items, or all of the items with which this term is associated. The phrase "one or more" is readily understood by one of skill in the art, particularly when read in context of its usage.

Each numerical or measured value in this specification is modified by the term "about." The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents of carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third, and upper third, etc.

As will also be understood by one skilled in the art, all language such as "up to," "at least," "greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the technology encompasses not only the entire group listed as a whole, but each member of the group individually and all possible subgroups of the main group. Additionally, for all purposes, the technology encompasses not only the main group, but also the main group absent one or more of the group members. The technology therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

What is claimed is:

1. A plant stalk decorticator comprising:

a frame;

a pair of feed rollers attached to the frame, the pair of feed rollers being arranged abutting one another along a substantially horizontal axis with a line of contact therebetween, the pair of feed rollers being configured to receive a plant stalk in the line of contact and at least partially flatten and feed the plant stalk below the pair of feed rollers in a substantially vertical orientation;

a splitting wedge attached to the frame and positioned at least partially below the pair of feed rollers and aligned along a substantially vertical axis that is substantially centrally located in the line of contact between the pair of feed rollers, the splitting wedge being configured to split the plant stalk fed from the pair of feed rollers into two plant fiber stalk halves;

a first pair of peeling rollers attached to the frame, the first pair of peeling rollers being arranged adjacent one another substantially parallel to the substantially vertical axis and being positioned below the pair of feed rollers and laterally from a first side of the substantially vertical axis;

a second pair of peeling rollers attached to the frame, the second pair of peeling rollers being arranged adjacent one another substantially parallel to the substantially vertical axis and being positioned below the pair of feed rollers and laterally from a second side of the substantially vertical axis such that the first pair of peeling rollers and the second pair of peeling rollers being substantially symmetrical about the substantially vertical axis;

each of the first and second pairs of peeling rollers being configured to receive a respective one of the plant fiber stalk halves from the splitting wedge and separate the plant fiber stalk half from the respective other one of the plant fiber stalk halves thereby forming plant fiber bark sections; and a plant stalk loader attached to a top of the frame, the plant stalk loader is configured to load at least one plant stalk into the line of contact between the pair of feed rollers, and wherein the plant stalk loader comprises a plurality of compartments formed into a matrix having a plurality of rows and a plurality of columns, and a support shelf positioned below the plurality of compartments.

2. The plant stalk decorticator of claim 1, wherein the splitting wedge comprises:

a bottom portion having a rectangular cross section; and a top portion having opposing tapered sides that form a triangular cross section, the top portion is configured to split the plant stalk into the two plant fiber bark sections.

3. The plant stalk decorticator of claim 2, wherein the splitting wedge is moveable between a top splitting position and a bottom passive position.

4. The plant stalk decorticator of claim 3, wherein the splitting wedge is in the bottom passive position after the splitting wedge has split the plant stalk and directed the plant fiber stalk halves to the first and second pair of peeling rollers.

5. The plant stalk decorticator of claim 3, wherein when the splitting wedge is in the top splitting position, a top point of the splitting wedge is within a range of about 3.2 mm below a substantially horizontal plane defined by a bottom of the pair of feed rollers to about 3.2 mm above the substantially horizontal plane defined by the bottom of the pair of feed rollers.

6. The plant stalk decorticator of claim 5, wherein when the splitting wedge is in the top splitting position, the top point of the splitting wedge is substantially aligned with the substantially horizontal plane defined by the bottom of the pair of feed rollers.

7. The plant stalk decorticator of claim 5, wherein when the splitting wedge is in the top splitting position, the top point of the splitting wedge is about 3.2 mm above the substantially horizontal plane defined by the bottom of the pair of feed rollers.

8. The plant stalk decorticator of claim 1, wherein each of the first and second pairs of peeling rollers comprises a top drive peeling roller and a bottom driven peeling roller, the top drive peeling roller has a diameter that is smaller than a diameter of the bottom driven peeling roller.

9. The plant stalk decorticator of claim 8, wherein the first and second pairs of peeling rollers are positioned such that the plant fiber stalk halves are received on the bottom driven peeling rollers.

10. The plant stalk decorticator of claim 1, wherein the plant stalk loader is positioned on a track attached to the top of the frame, the plant stalk loader is configured to slide along the track to load plant stalks from each of the plurality of rows of compartments sequentially into the line of contact between the pair of feed rollers via a slot in the support shelf.

11. The plant stalk decorticator of claim 8, further comprising a cutting mechanism positioned adjacent an exit side of each of the first and second pairs of peeling rollers, the cutting mechanism is configured to cut the plant fiber bark sections that exit the pairs of peeling rollers into a plurality of fiber bark strips having a predetermined uniform length.

12. The plant stalk decorticator of claim 11, wherein the cutting mechanism comprises a guillotine cutter that is configured to move substantially vertically up and down at predetermined intervals to cut the plant fiber sections.

13. The plant stalk decorticator of claim 11, wherein the cutting mechanism comprises a cutting wheel having a plurality of protrusions and is configured to rotate such that the protrusions cut the plant fiber sections.

14. The plant stalk decorticator of claim 13, wherein the rotation of the cutting wheel is coordinated with rotation of the top drive peeling roller.

15. The plant stalk decorticator of claim 8, wherein the rotational speed of the first and second top drive peeling rollers are coordinated mechanically or electromechanically.

16. The plant stalk decorticator of claim 15, wherein the rotational speed of the pair of feed rollers is coordinated mechanically or electromechanically with the rotational speed of the first and second top drive peeling rollers such that a velocity of the plant stalk fed through the pair of feed roller is equal to a velocity of the plant fiber bark sections pulled through the first and second pairs of peeling rollers.

17. The plant stalk decorticator of claim 1, wherein the plant stalk is from a bast fiber plant.

18. The plant stalk decorticator of claim 17, wherein the bast fiber plant is hemp.

19. The plant stalk decorticator of claim 1, wherein each of the pair of feed rollers and the first and second pairs of peeling rollers comprises a metal roller coated with a layer of rubber.

20. The plant stalk decorticator of claim 1, wherein each of the pair of feed rollers and the first and second pairs of peeling rollers comprises a solid metal roller.

21. A plant stalk decorticator comprising:

a frame;

a pair of feed rollers attached to the frame, the pair of feed rollers being arranged abutting one another along a substantially horizontal axis with a line of contact therebetween, the pair of feed rollers being configured to receive a plant stalk in the line of contact and at least partially flatten and feed the plant stalk below the pair of feed rollers in a substantially vertical orientation;

a splitting wedge attached to the frame and positioned at least partially below the pair of feed rollers and aligned along a substantially vertical axis that is substantially centrally located in the line of contact between the pair of feed rollers, the splitting wedge being configured to split the plant stalk fed from the pair of feed rollers into two plant fiber stalk halves;

a first pair of peeling rollers attached to the frame, the first pair of peeling rollers being arranged adjacent one another substantially parallel to the substantially vertical axis and being positioned below the pair of feed rollers and laterally from a first side of the substantially vertical axis;

a second pair of peeling rollers attached to the frame, the second pair of peeling rollers being arranged adjacent one another substantially parallel to the substantially vertical axis and being positioned below the pair of feed rollers and laterally from a second side of the substantially vertical axis such that the first pair of peeling rollers and the second pair of peeling rollers being substantially symmetrical about the substantially vertical axis;

each of the first and second pairs of peeling rollers are configured to receive a respective one of the plant fiber stalk halves from the splitting wedge and separate the plant fiber stalk half from the respective other one of the plant fiber stalk halves thereby forming plant fiber bark sections; and a cutting mechanism positioned adjacent an exit side of each of the first and second pairs of peeling rollers, the cutting mechanism being configured to cut the plant fiber bark sections that exit the pairs of peeling rollers into a plurality of fiber bark strips having a predetermined uniform length.

22. The plant stalk decorticator of claim 21, wherein the cutting mechanism comprises a guillotine cutter that is configured to move substantially vertically up and down at predetermined intervals to cut the plant fiber sections.

23. The plant stalk decorticator of 21, wherein the cutting mechanism comprises a cutting wheel having a plurality of protrusions and is configured to rotate such that the protrusions cut the plant fiber sections.

24. The plant stalk decorticator of claim 21, wherein each of the first and second pairs of peeling rollers comprises a top drive peeling roller and a bottom driven peeling roller, the top drive peeling roller has a diameter that is smaller than a diameter of the bottom driven peeling roller.

25. The plant stalk decorticator of claim 24, wherein the first and second pairs of peeling rollers are positioned such that the plant fiber stalk halves are received on the bottom driven peeling rollers.

26. The plant stalk decorticator of claim 24, wherein the rotation of the cutting wheel is coordinated with rotation of the top drive peeling roller.

* * * * *